US008100292B2

(12) United States Patent
Kelly et al.

(10) Patent No.: US 8,100,292 B2
(45) Date of Patent: Jan. 24, 2012

(54) INTEGRATED COLUMN WALL FOR A VENDING MACHINE

(75) Inventors: Paul Hayward Kelly, Aiken, SC (US); Edmund Scott Richardson, Simpsonville, SC (US); Terring M. Ware, Aiken, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 1622 days.

(21) Appl. No.: 10/678,155

(22) Filed: Oct. 6, 2003

(65) Prior Publication Data

US 2004/0104645 A1 Jun. 3, 2004

Related U.S. Application Data

(60) Provisional application No. 60/415,768, filed on Oct. 4, 2002.

(51) Int. Cl.
*B65H 31/20* (2006.01)
*G07F 11/16* (2006.01)

(52) U.S. Cl. ..... 221/241; 221/312 R; 221/312 C; 221/131; 221/67; 221/45; 221/92; 221/123; 221/124; 221/133; 221/282; 221/281; 52/729.1; 52/223.8; 361/685

(58) Field of Classification Search ..... 221/241, 221/312 R, 312 C, 131, 67, 92, 123, 124, 221/133, 282, 281, 45; 312/45; 52/729.1, 52/223.8; 361/685
See application file for complete search history.

(56) References Cited

U.S. PATENT DOCUMENTS 2,180,317 A * 11/1939 Davis ..... 52/319
2,302,194 A * 11/1942 Dayton ..... 403/217
2,359,398 A * 10/1944 Thompson et al. ..... 194/299
2,501,357 A * 3/1950 Speckman et al. ..... 221/58
2,540,482 A * 2/1951 Hervey ..... 244/123.9
2,694,505 A * 11/1954 Hedges ..... 221/82
2,993,572 A * 7/1961 Rich ..... 160/229.1
3,026,002 A * 3/1962 Torres ..... 221/67
3,066,843 A * 12/1962 Johnson ..... 221/70
3,327,896 A * 6/1967 Asenbauer ..... 206/509
3,648,755 A * 3/1972 Thiele ..... 160/201
3,744,866 A * 7/1973 Cook ..... 312/42
3,757,998 A * 9/1973 Millies et al. ..... 221/242
3,848,324 A 11/1974 Perger
4,008,745 A * 2/1977 Bailey ..... 160/229.1
4,291,510 A * 9/1981 Sivachenko ..... 52/91.3
4,498,584 A * 2/1985 Newbury ..... 206/510

(Continued)

FOREIGN PATENT DOCUMENTS

DE 10221776 A1 * 12/2002

(Continued)

*Primary Examiner* — Gene O. Crawford
*Assistant Examiner* — Rakesh Kumar

(57) ABSTRACT

A vending machine includes a plurality of column walls that collectively define an associated plurality of stack areas for storing product containers. The column wall includes various, vertically spaced and fore-to-aft extending stiffeners embossed into the column wall. The integral stiffeners eliminate the need for any additional discrete stiffener parts and fasteners. In addition, the integral stiffeners advantageously permit thinner material to be employed in forming the column walls, thereby improving the entire manufacturing process. Preferably, one of the stiffeners constitutes a decoupling member which isolates a bottom portion of the column wall from a top portion and substantially prevents bow forces from transferring into a dispensing region of the column wall. Furthermore, each of the column walls is integrally formed with an alignment member or louver structure in the form of a guide element or flange which provides for proper product positioning through a vending area.

33 Claims, 8 Drawing Sheets

U.S. PATENT DOCUMENTS 4,823,983 A * 4/1989 Groover et al. ..... 221/92
4,991,740 A * 2/1991 Levasseur ..... 221/114
5,299,405 A * 4/1994 Thompson ..... 52/783.11
5,529,207 A * 6/1996 Oden et al. ..... 221/67
5,547,105 A 8/1996 Oden et al.
5,651,476 A * 7/1997 Percy et al. ..... 221/131
5,671,573 A * 9/1997 Tadros et al. ..... 52/223.8
5,711,444 A * 1/1998 Meacham et al. ..... 220/6
5,713,490 A * 2/1998 Oden et al. ..... 221/242
5,805,075 A * 9/1998 Carlson et al. ..... 312/215
5,819,578 A 10/1998 Codatto
5,848,724 A 12/1998 Uzzle et al.
D407,501 S * 3/1999 Shipman et al. ..... D25/58
5,893,482 A * 4/1999 Lang ..... 221/67
6,012,256 A * 1/2000 Aschheim ..... 52/167.1
6,209,842 B1 * 4/2001 Anderson et al. ..... 248/560
6,302,293 B1 * 10/2001 Wittern et al. ..... 221/92
6,318,275 B1 * 11/2001 Basile et al. ..... 105/422
6,373,695 B1 * 4/2002 Cheng ..... 361/685
6,381,917 B1 * 5/2002 Thielow et al. ..... 52/784.1
6,427,866 B1 * 8/2002 Hawker et al. ..... 221/132
6,431,398 B1 * 8/2002 Cook et al. ..... 221/124
6,467,649 B1 * 10/2002 Ullman et al. ..... 221/192
6,513,887 B2 * 2/2003 Paczkowski et al. ..... 312/45
6,633,481 B2 * 10/2003 Pavol ..... 361/685
6,877,634 B2 * 4/2005 Tramontina et al. ..... 221/53
6,915,907 B2 * 7/2005 Myers ..... 206/782
6,945,427 B2 * 9/2005 Hieb ..... 221/10
2002/0078645 A1 * 6/2002 Meyer ..... 52/289
2005/0144892 A1 * 7/2005 Strickland et al. ..... 52/729.1

FOREIGN PATENT DOCUMENTS

EP 1530172 A2 * 5/2005

* cited by examiner

INTEGRATED COLUMN WALL FOR A VENDING MACHINE

CROSS-REFERENCE TO RELATED APPLICATIONS

The present application claims benefit to U.S. Provisional Patent Application Serial No. 60/415,768 entitled "INTEGRATED COLUMN WALL FOR VENDING MACHINE" filed on Oct. 4, 2002.

BACKGROUND OF THE INVENTION

1. Field of the Invention

The present invention pertains to the art of vending machines and, more particularly, to an internal column wall construction including integral stiffeners and isolation slot structure for a vending machine.

2. Discussion of the Prior Art

In a vending machine, internal column walls are employed to define product storage magazines or zones. More specifically, a series of column walls are arranged at spaced positions within a vending cabinet and serve as partitions to contain, separate, and support a stack of products to be dispensed. The overall series of column walls are interconnected to maintain their desired spaced relationships by a plurality of cross braces, including vertically spaced front and rear braces, as well as top cross braces.

Regardless of the existence of the cross bracing which effectively capture the front, rear and top portions of the column walls, the center sections of the column walls still need to be stiffened in order to prevent bowing which can hamper proper product dispensing. To address this potential problem, prior art column wall designs employ various discrete, stiffening components which extend fore-to-aft along and are mechanically fastened to the respective column walls to ensure proper function.

FIGS. 1 and 2 illustrate a known vending cabinet assembly 2 wherein a plurality of parallel column walls 4 are maintained in a laterally spaced relationship by various cross brace members, such as those indicated at 5-9. To address bowing concerns, each of the column walls 4 is provided with multiple stiffening components 10-12. More specifically, each of the stiffening components 10-12 is mechanically fastened, such as through the use of welding, screwing or the like to a respective one of the column walls 4.

Obviously, this construction requires a significant number of parts and assembly to establish the overall vending cabinet. That is, with particular reference to the stiffening components, numerous separate fastening locations must be individually established for each of the stiffening components. Certainly this assembly process can significantly add to the manufacturing costs. In addition to employing separate stiffening components, the prior art also attaches additional structure to the column walls in connection with aiding in the proper positioning of products to be dispensed.

Based on the above, there exists a need in the art for an improved column wall construction arrangement for a vending machine. More specifically, there exists a need for an column wall system which is advantageously stiffened and incorporates enhanced product positioning structure, while being cost effective and efficient to manufacture.

SUMMARY OF THE INVENTION

The present invention is directed to an enhanced column wall construction for a vending machine wherein the column wall includes integral stiffeners. In accordance with the preferred embodiment of the invention, various, vertically spaced and fore-to-aft extending stiffeners are embossed into the column wall, thereby eliminating the need for any additional discrete stiffener parts and fasteners. In addition, the integral stiffeners advantageously permit thinner material to be employed in forming the column walls, thereby improving the entire manufacturing process by reducing the material weight, tooling and press factors, and assembly handling requirements.

In accordance with another aspect of the invention, each of the column walls is integrally formed with louver structure in the form of a flange which provides for product positioning through a vending area. That is, instead of requiring another, individual component to be attached to a column wall for product positioning purposes, such as a hat channel, shim or similar functioning component with associated fasteners, the column wall is actually formed with structure which provides the requisite product positioning function. Furthermore, the column wall is designed to avoid any bow force transfer from an upper section of the column wall to a lower section thereof by incorporating a lowermost decoupling stiffener.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
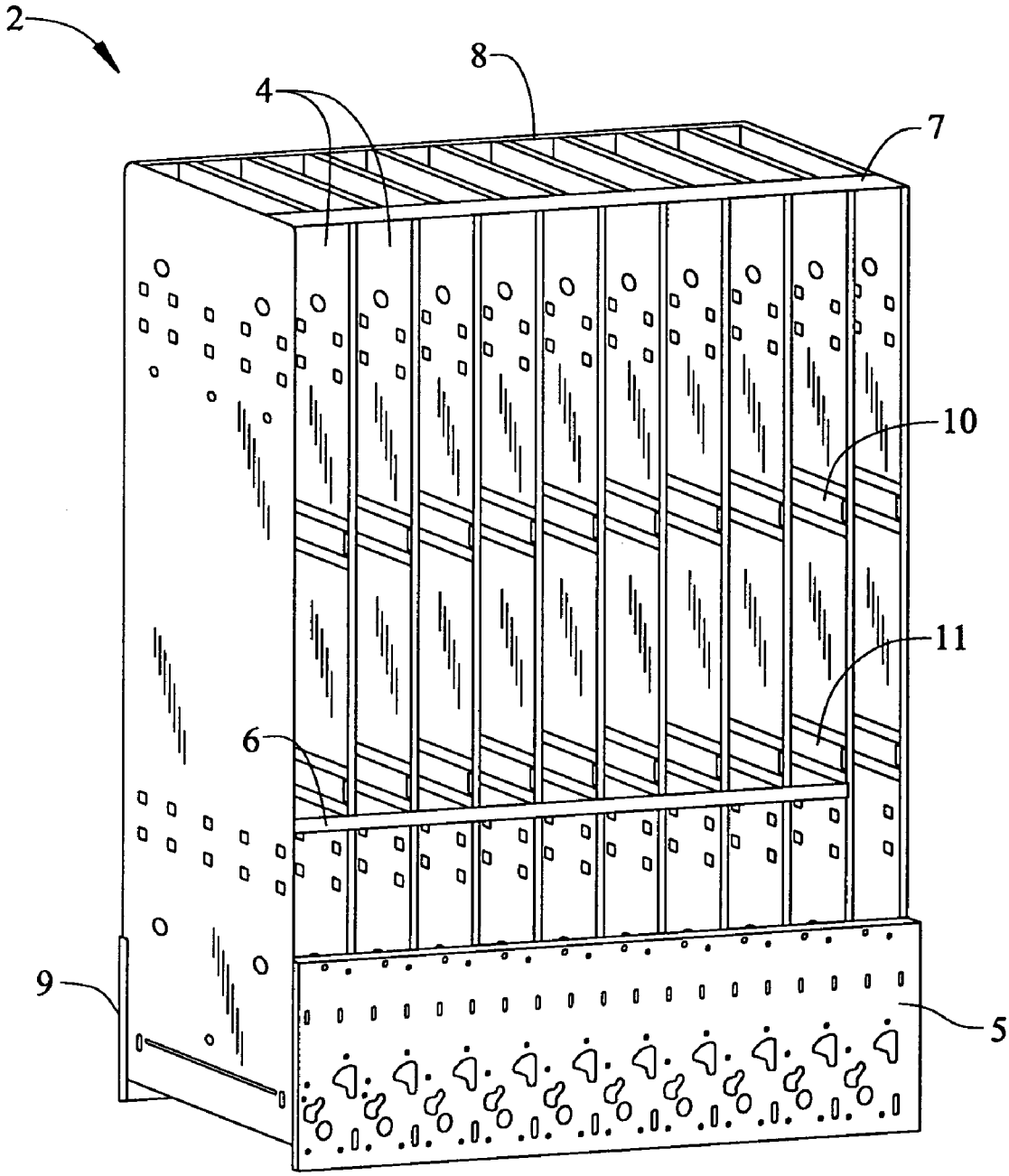
FIG. 1 (PRIOR ART)
FIG. 1 is perspective view of an assembled internal vending cabinet stack structure constructed in accordance with the prior art.
Figure 2:
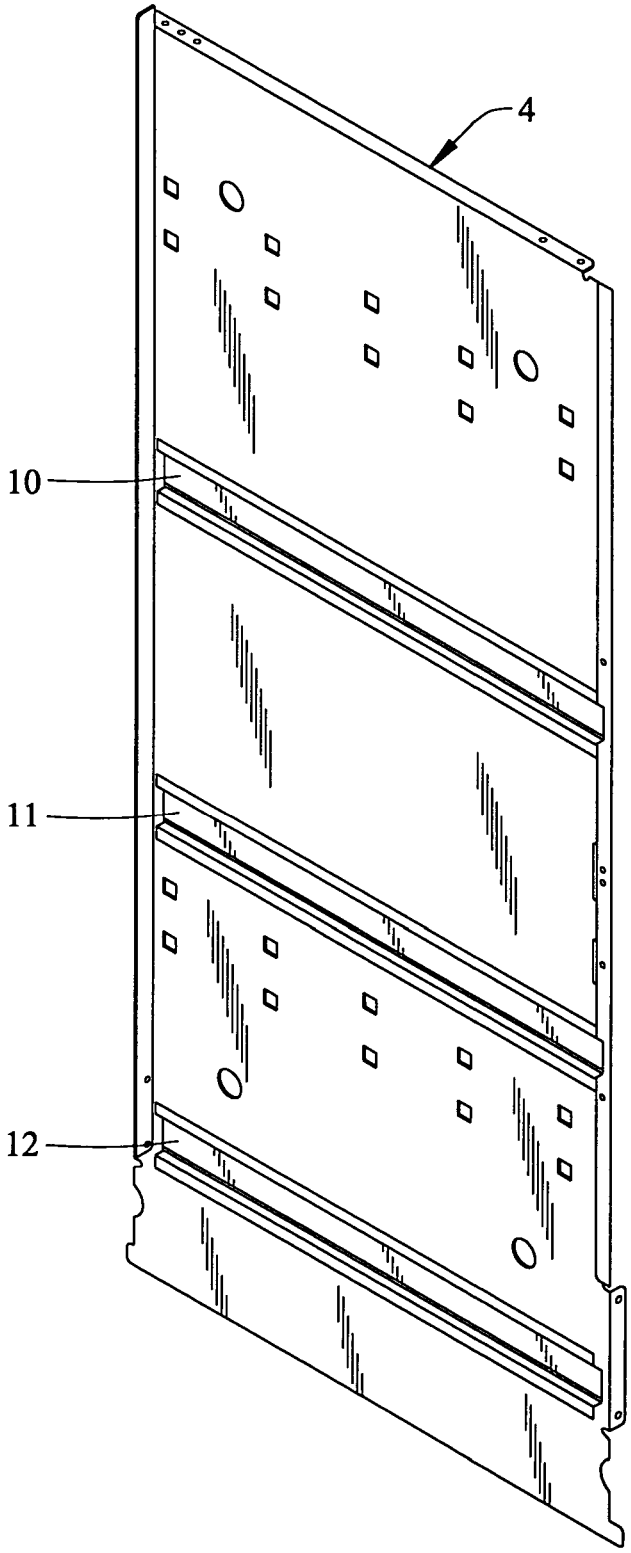
FIG. 2 (PRIOR ART)
FIG. 2 is a perspective view of a single column wall employed in the prior art vending cabinet structure of FIG. 1.
Figure 3:
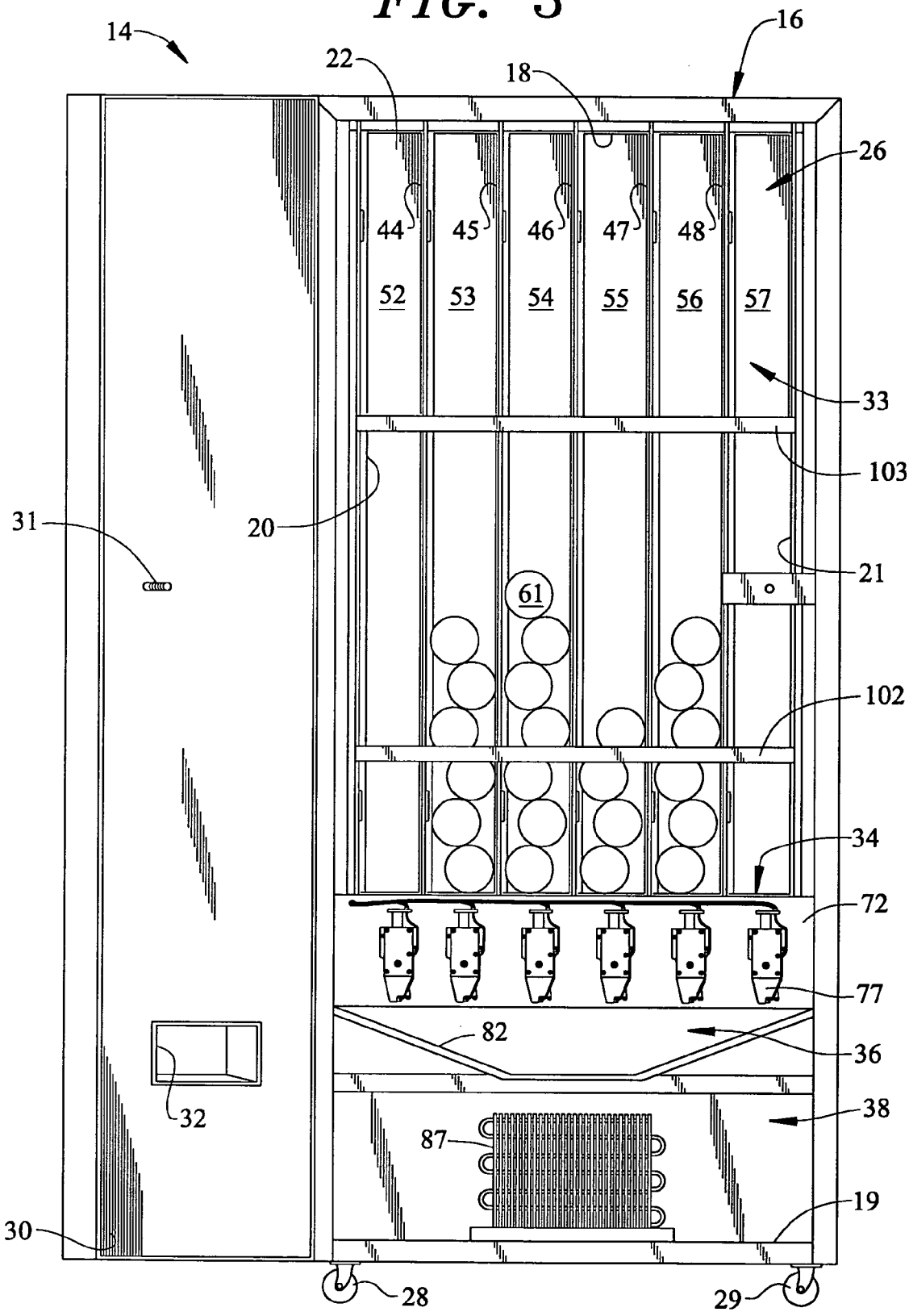
FIG. 3 is a front elevational view of a vending machine including integrated column walls constructed in accordance with the present invention.

With initial reference to FIG. 3, a vending machine 14 includes a cabinet frame 16 having top, bottom, side and rear walls 18-22 that collectively define a central cavity 26. In a manner known in the art, a first pair of wheels or casters 28 and 29 are secured to a front edge portion of bottom wall 19 to facilitate the positioning of vending machine 14. Of course it should be realized that a second pair of wheels (not shown) are also arranged on a rear portion of bottom wall 19. A door 30 is pivotally mounted to cabinet frame 16 to selectively enable access to central cavity 26 in order to load various product containers or other commodities into vending machine 14. Door 30 is provided with a locking mechanism, shown in the form of a threaded rod 31, to retain door 30 in a closed position so as to prevent pilfering of the commodities from central cavity 26. Door 30 is also provided with an opening 32 to enable a consumer to remove a vended product container or other commodity from vending machine 14.

Central cavity 26 includes a storage section 33, a dispensing section 34, a delivery section 36 and a lower section 38. Storage section 33 is provided to hold products in escrow until a vending operation is performed. Towards that end, storage section 33 is provided with a plurality of vertically extending column walls 44-48 which, together with side walls 20 and 21, form a plurality of column or stack areas 52-57. In the embodiment shown in FIG. 3, stack areas 52-57 constitute single stack columns. However, it should be understood that the present invention also encompasses vending machines having multi-stack columns. In any event, stack areas 52-57 are partitioned by walls 44-48 to contain, separate and support a plurality of generally cylindrical containers 61 which, in the embodiment shown, constitute soda cans.

As further shown in FIG. 3, dispensing section 34 is provided with a frontal support wall 72 having arranged thereon a plurality of vend motors, one of which is indicated at 77. As will be discussed more fully below, a plurality of cradles (not shown) are arranged behind frontal support wall 72. Actually, each column or stack area 52-57 is provided with an associated cradle (not shown) that is operated through a respective one of the plurality of vend motors 77. Upon selection of a particular product container 61 or other commodity, one of the plurality of vend motors 77 is activated to rotate a respective cradle causing a product container 61, corresponding to the selected product, to emerge from vending machine 14. That is, product container 61 is transported to a product delivery chute 82 provided in delivery section 36 which is exposed to opening 32 in door 30. In order to maintain containers 61 in a refrigerated state, lower section 38 is provided with a cooling system 87. In general, the above description is provided for the sake of completeness and to enable a better understanding of the invention. The present invention is particularly directed to the structure and configuration of column walls 44-48.

Figure 4:
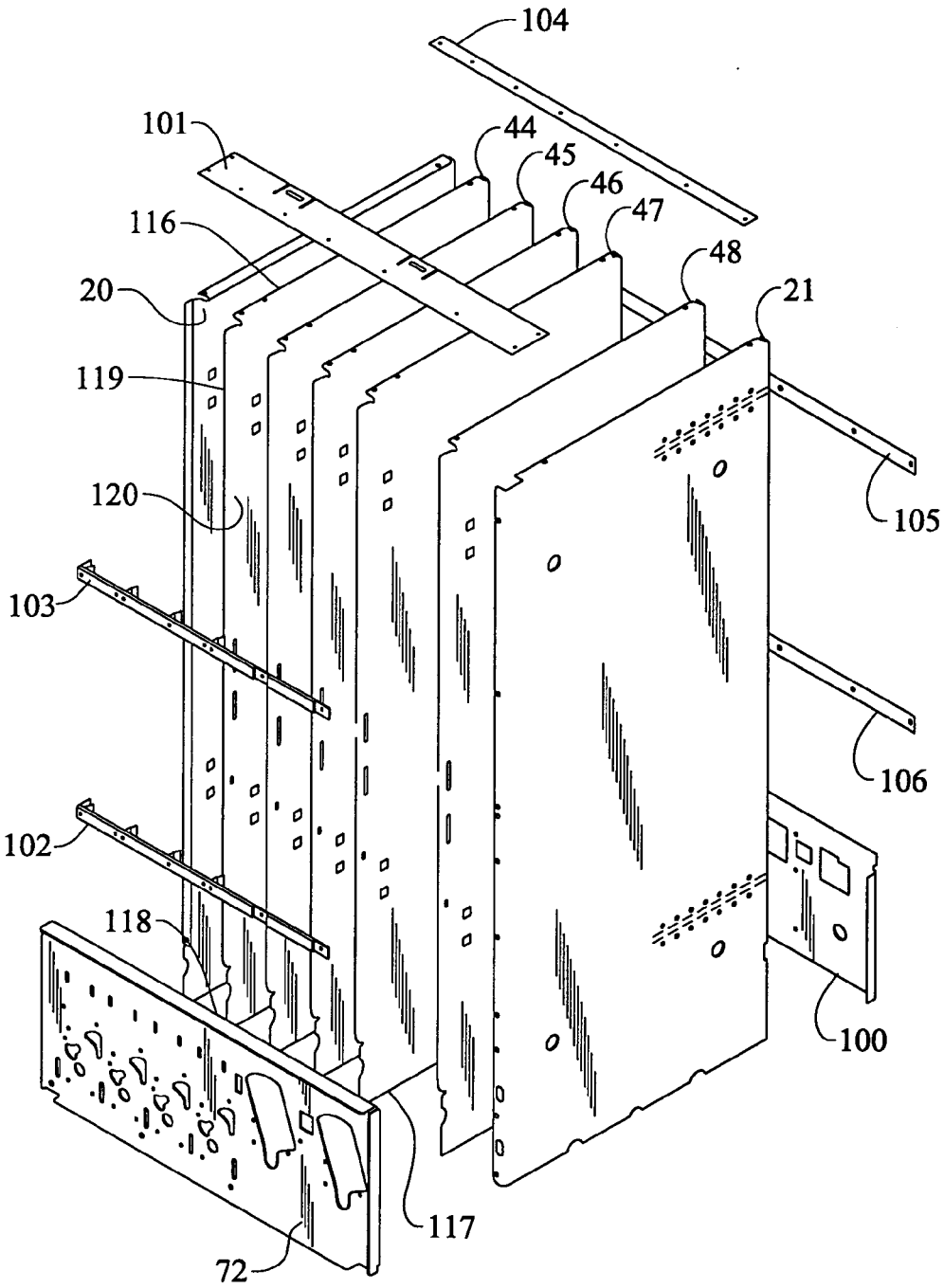
FIG. 4 is an exploded view of internal vending cabinet structure including column walls constructed in accordance with the present invention.
Figure 5:
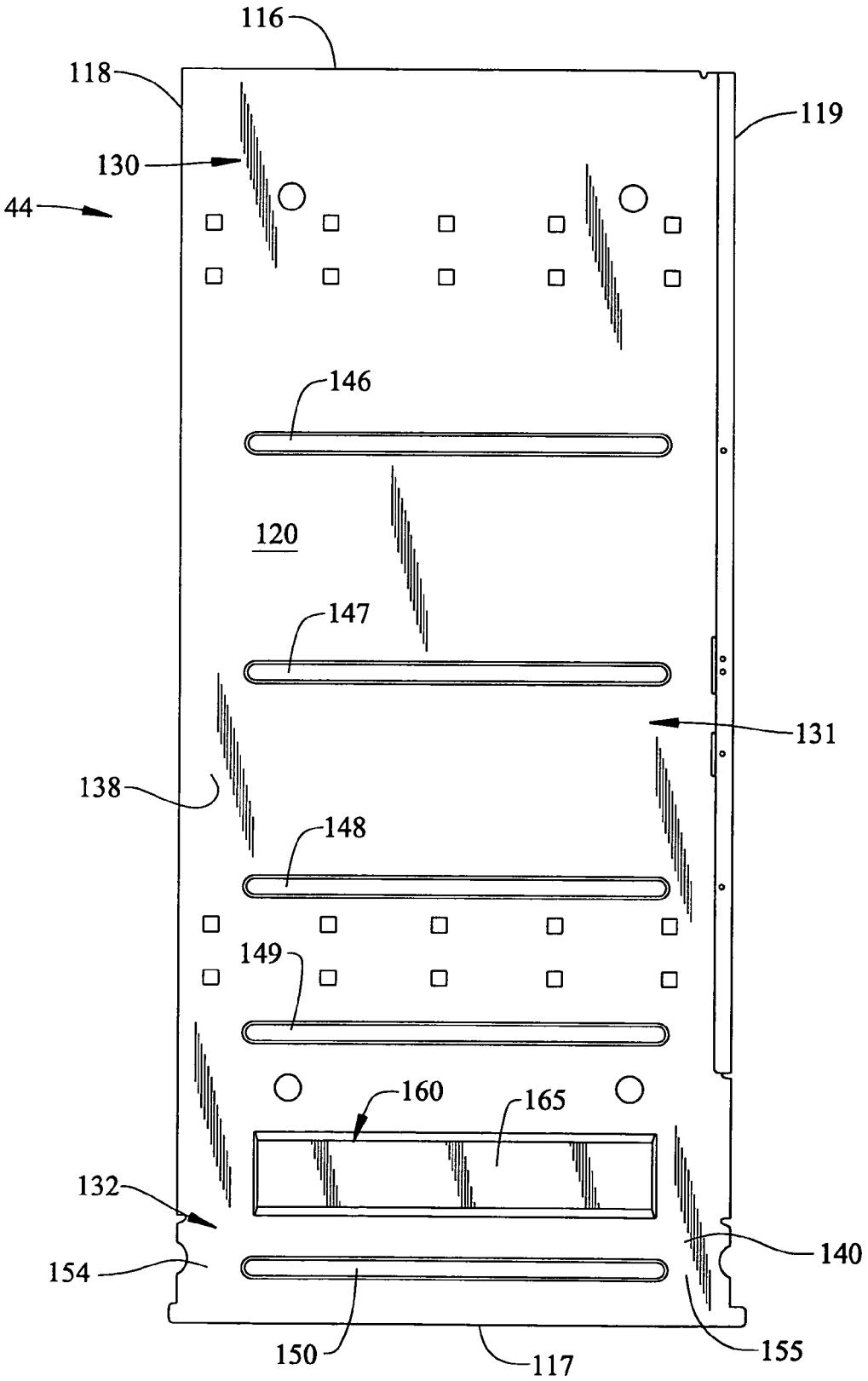
FIG. 5 is an elevational side view of one of the column walls shown in FIG. 4.

As best illustrated in FIG. 4, column walls 44-48 are constituted by substantially rectangular sheets of material bound together to collectively form storage section 33. That is, in addition to frontal support wall 72, column walls 44-48 are supported by a rear support wall or panel 100, an upper support plate 101 and a plurality of cross-braces or support straps 102-106 that are strategically arranged about column walls 44-48 to provide support and stability for stack areas 52-57.

Reference will now be made to FIGS. 5-9 in describing the particular structure of column walls 44-48. As each column wall 44-48 is substantially identical, a description of column wall 44 will be made and it is to be understood that column walls 45-48 have commensurate structure. Column wall 44 is formed from a single sheet of material having a top edge 116, a bottom edge 117 and opposing side edges 118 and 119 that collectively define a substantially planar surface 120. Planar surface 120 is divided into a plurality of regions. That is, planar surface 120 includes a top portion 130, an intermediate portion 131 and a bottom portion 132. More specifically, top portion 130 and intermediate portion 131 combine to define a storage region 138, while bottom portion 132 defines a dispensing region 140.

Figure 6:
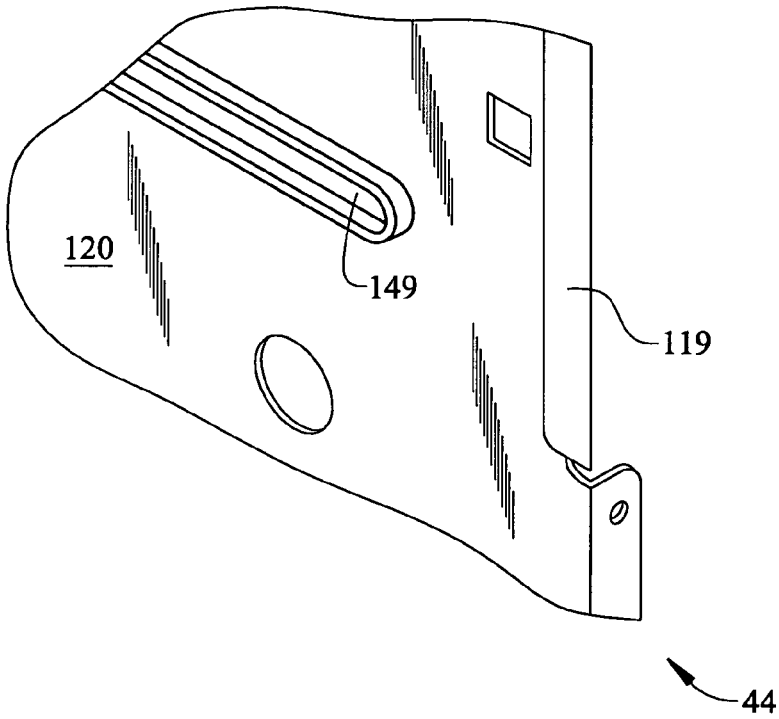
FIG. 6 is a partial, isometric view of integral stiffeners incorporated in the column walls of FIG. 5.
Figure 7:
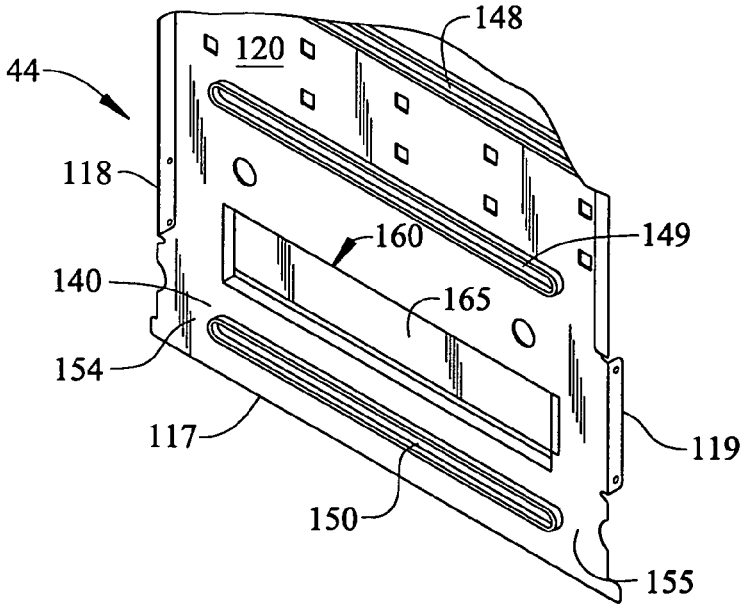
FIG. 7 is a perspective view of a lower portion of the column wall of FIG. 5.
Figure 8:
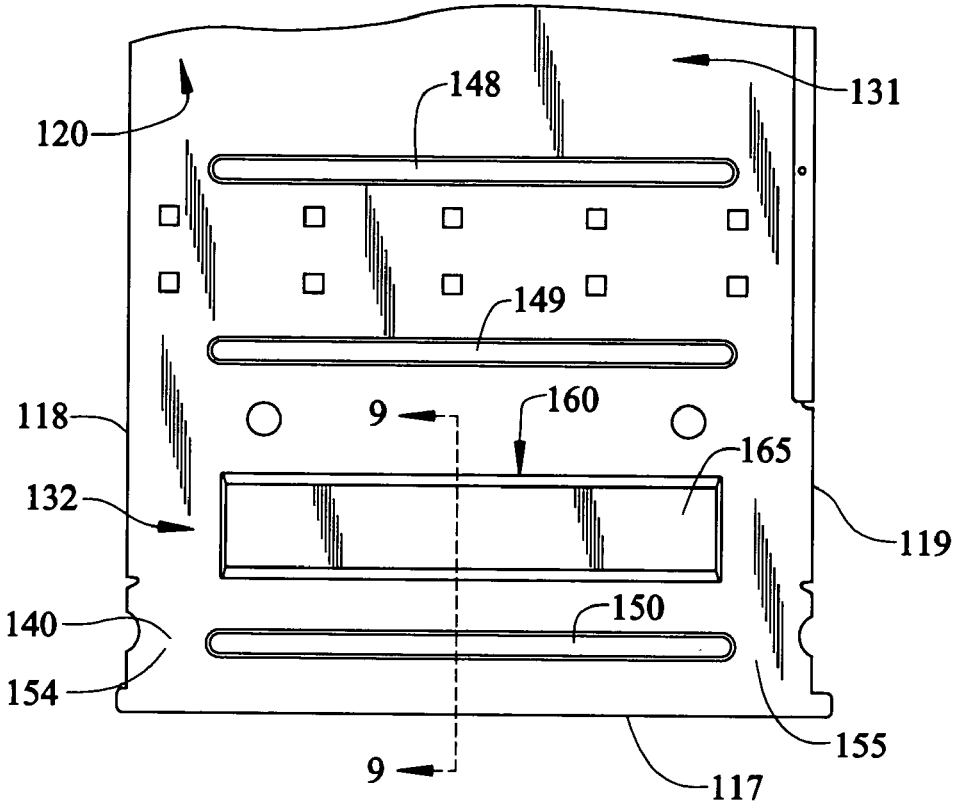
FIG. 8 is a side elevational view of a lower portion of the column wall of FIG. 5.

In order to provide stability to column wall 44, considered particularly important in connection with the area of storage region 138, a plurality of stiffening elements 146-150 are provided on planar surface 120. In accordance with the most preferred embodiment of the present invention, stiffening elements 146-150 are integrally formed into planar surface 120 and extend fore-to-aft between opposing edges 118 and 119. As best illustrated in FIG. 6, stiffening elements 146-150 are actually embossed or stamped into planar surface 120. In the most preferred form, stiffeners 146-150 define substantially horizontally extending, narrow slots. However, stiffeners 146-150 could also be defined by embossed lands extending fore-to-aft across planar surface 120. In any event, stiffening elements 146-149 are provided about storage region 138 in order to reduce bowing of column wall 44 when stack area 53 is filled with product containers 61. In any case, with this overall construction, column walls 44-48 can be formed from a thinner gauge metal. That is, in the prior art, the column walls would have been formed from sheet metal having a thickness of between approximately 0.084" and 0.097" (approximately 2.0-2.5 mm) or approximately 13 gauge sheet metal. The present invention allows column walls 44-48 to be formed from sheet metal having a thickness of approximately 0.058" to 0.069" (approximately 1.5-1.75 mm) or approximately 16 gauge sheet metal. Thus, use of the present invention lowers material and production costs and enhances the manufacturing process.

In accordance with one aspect of the most preferred embodiment, stiffening member 150 actually serves a dual purpose. In addition to enhancing overall structural integrity of column wall 44, stiffening member 150 also acts to decouple dispensing region from storage region 138. In general, a weight of product containers 61 arranged in storage region 138 has a tendency to cause planar surface 120 to slightly deform and lower edge 117 to bow inward. The inward bowing of lower edge 117 could cause product containers 61 to become trapped or jammed in dispensing region 140, thereby interfering with or otherwise causing inconsistencies in the overall vend operation. In order to prevent the transferring of a bow force from storage region 138 into dispensing region 140, stiffening member 150 is arranged at bottom portion 132 of planar surface 120. That is, as stiffening member 150 includes a fore-to-aft extending, elongated narrow slot, dispensing region 140 is loosely connected to storage region 138 through narrow webs of material as indicated at 154 and 155 in FIG. 5. In this manner, any bow forces developed in storage region 138 can only be transferred through web portions 154-155 into dispensing region 140. The minimal transfer zones aid in assuring that dispensing region 140 will be held straight even when storage region 138 shifts or floats. This decoupling of the bow forces substantially reduces vend errors resulting from product containers 61 being out of alignment.

Figure 9:
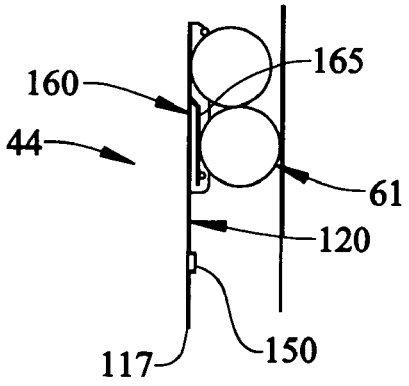
FIG. 9 is a cross-sectional view generally taken along line 9-9 in FIG. 8, while illustrating the repositioning of vending products in accordance with the invention.

Before product containers 61 pass from storage region 138 into dispensing region 140, the product containers 61 must be properly aligned or oriented in order to enter into a cradle or oscillator (not shown). To address this requirement in accordance with the present invention, column wall 44 is provided with a louver structure or alignment element 160 having a flange or guide surface 165. Alignment member 160, and by extension guide surface 165, is integrally formed from planar surface 120. More specifically, guide surface 165 is preferably stamped from planar surface 1230 and formed to project outward from column wall 44. Guide surface 165 causes each product container 61 to move and shift away from planar surface 120 of column wall 44 and align within stack area 53 for proper dispensing purposes. That is, product containers 61 travel downward in stack area 53 through dispensing operations. As best seen in FIG. 9, during a lowermost portion of that downward travel, the product containers 61 will contact guide surface 165 and shift laterally away from column wall 44 for subsequent dispensing. In this manner, each product container 61 is properly positioned in a pre-vend position prior to entering the cradle or oscillator (not shown).

As indicated above, the overall construction of column wall 44 provides a substantial reduction in manufacturing and fabrication costs. By integrally forming the stiffening elements and alignment member from with the column wall, mechanical fasteners are eliminated and fabrication time is reduced. Moreover, the integral stiffeners allow for a thinner material than traditionally used in fabricating the column walls. In any case, the present invention enhances the overall manufacturing process by reducing material weight, tooling and press factors, as well as assembly handling requirements, without sacrificing the mechanical performance of the column wall.

Figure 10:
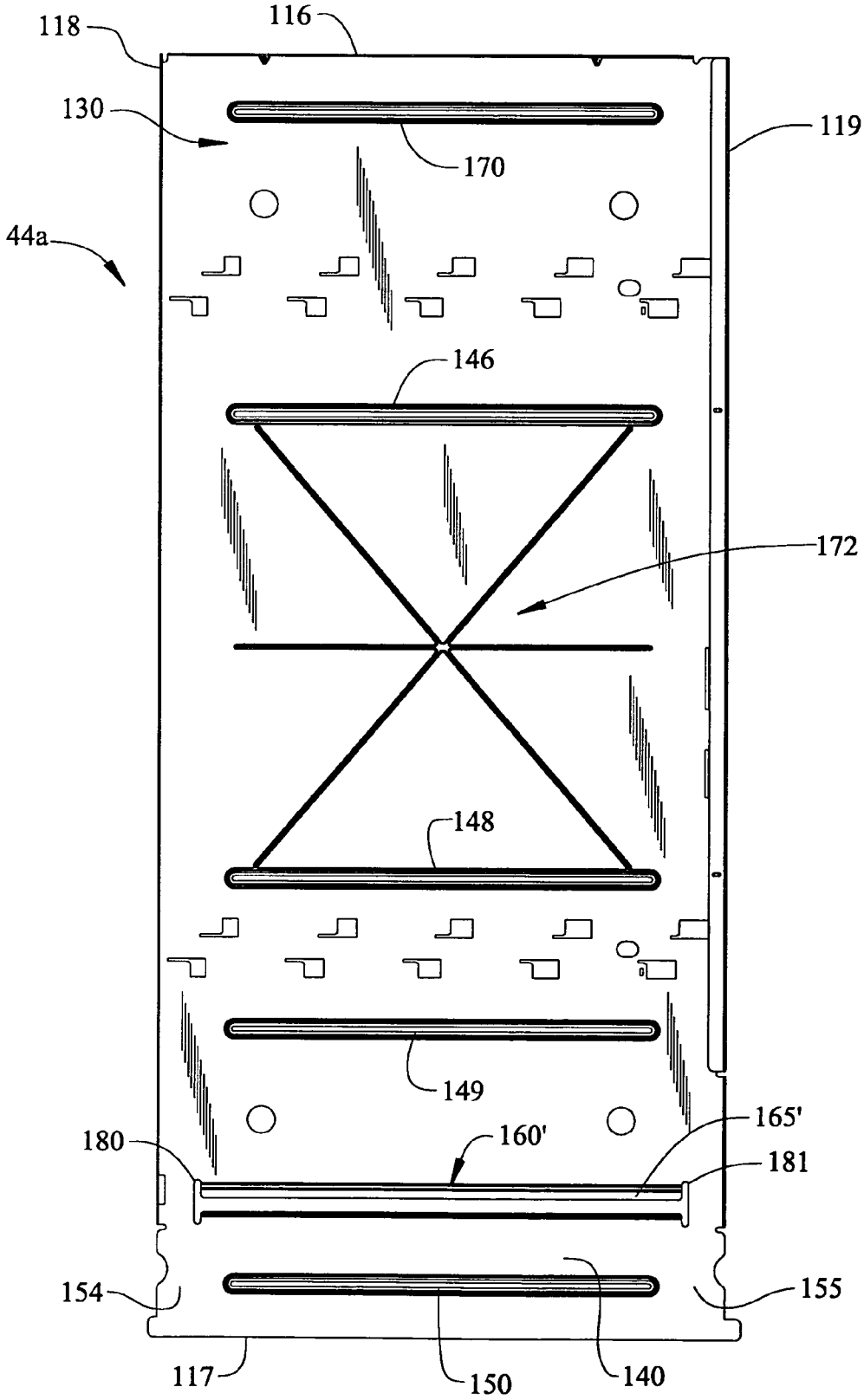
FIG. 10 is an elevational side view of a column wall, similar to that of FIG. 5, constructed in accordance with a second embodiment.

Although described with reference to a preferred embodiment of the present invention, it should be readily apparent to one of ordinary skill in the art that various changes and/or modifications can be made to the invention without departing from the spirit thereof. For instance, the overall number of stiffening elements can be varied depending on the particular construction of the vending machine. As one example, FIG. 10 depicts a column wall 44*a* constructed in accordance with another embodiment of the invention. Of particular interest, it should be noted that column wall 44*a* includes an additional upper stiffening element 170. Also, stiffening element 147 of the FIG. 5 embodiment has been replaced by a stiffener structure 172. In the embodiment shown, stiffening structure 172 interconnects stiffening elements 146 and 148 and takes the form of a star or asterisk. However, other stiffener configurations, such as an X or H arrangement, could also be employed. This arrangement has been found to provide enhanced overall strength to storage region 138, thereby minimizing the potential bowing. Furthermore, the overall size and structure of alignment element 160 and guide surface 165 of the FIG. 5 embodiment can be reduced to that shown at 160' and 165'. Finally, notches, such as those indicated at 180 and 181, can be employed for added strength. While the present invention has been described with respect to a single stack column wall, it should be apparent that the present invention would be equally acceptable in forming multi-stack column walls. In general, the invention is only intended to be limited to the scope of the following claims.

We claim:

1. A vending machine comprising:

a cabinet frame including top, bottom, side and rear walls that collectively define a central cavity;

a door pivotally mounted to the cabinet frame, said door being selectively movable between an open condition, wherein access to the central cavity is permitted for loading of product containers into the vending machine, and closed condition, wherein dispensing of product containers is permitted; and a plurality of column walls arranged within the cabinet frame and separating the central cavity into a plurality of product stack areas, each of said plurality of column walls being formed from a material sheet having top, bottom and side edges that define a substantially planar wall surface, said wall surface including a plurality of integrally formed stiffening elements extending between the side edges, and an integrally formed alignment member, wherein the stiffening members minimize bowing of the plurality of column walls under a weight of product containers, the integrally formed alignment member provides for proper positioning of product containers within the product stack areas for dispensing from the vending machine, and at least one of the plurality of stiffening elements comprises a decoupling member isolating a first area of the column wall from a second area of the column wall to minimize forces in the first area from being transferred to the second area.

2. The vending machine according to claim 1, wherein each of the plurality of column walls includes top, bottom and intermediate portions, said top and intermediate portions defining a storage region and said bottom portion defining a dispensing region.

3. The vending machine according to claim 2, wherein each of the top, bottom and intermediate portions includes at least one of the plurality of stiffing elements.

4. The vending machine according to claim 3, wherein the at least one of the plurality of stiffening elements constitutes a decoupling member provided on the bottom portion, said decoupling member isolating the dispensing region from the storage region to minimize forces in the top and intermediate portions from being transferred to the bottom portion.

5. The vending machine according to claim 4, wherein the bottom portion is separated from the intermediate portion only through narrow web members.

6. The vending machine according to claim 5, wherein the integrally formed alignment member is formed in the dispensing region.

7. The vending machine according to claim 6, wherein the integrally formed alignment member includes a guide element, said guide element being adapted to guide the product container away from the column wall,

8. The vending machine according to claim 2, wherein the integrally formed alignment member is formed in the dispensing region.

9. The vending machine according to claim 8, wherein the integrally formed alignment member includes a guide element, said guide element being adapted to guide the product container away from the column wall.

10. The vending machine according to claim 8, wherein the integrally formed alignment member is stamped from the material sheet.

11. The vending machine according to claim 1, wherein each of the plurality of stiffening elements defines an elongated, narrow slot,

12. The vending machine according the claim 11, wherein each of the plurality of stiffening elements extends fore-to-aft across the wall surface,

13. The vending machine according to claim 12, wherein each of the plurality of stiffening elements is stamped from the material sheet,

14. The vending machine according to claim 2, further comprising: a stiffener structure interconnecting at least two of the plurality of stiffening elements.

15. The vending machine according to claim 14, wherein the stiffener structure takes a form of an asterisk.

16. The vending machine according to claim 14, wherein the stiffener structure interconnects the at least two of the plurality of stiffening elements in the intermediate portion.

17. The vending machine according to claim 1, wherein the material sheet is made of 16 gauge sheet metal.

18. A vending machine comprising:

a cabinet frame including top, bottom, side and rear walls that collectively define a central cavity;

a door pivotally mounted to the cabinet frame, said door being selectively movable between an open condition, wherein access to the central cavity is permitted for loading of product containers into the vending machine, and a closed condition, wherein dispensing of product containers is permitted;

a plurality of column walls arranged within the cabinet frame and separating the central cavity into a plurality of product stack areas, each of said plurality of column walls being formed , from a material sheet having top, bottom and side edges that define a substantially planar wall surface, said planar surface being defined by a storage region and a dispensing region; and a stiffening element extending fore-to-aft across the planar surface in the dispensing region, said stiffening element comprising a decoupling member separating the bottom edge from the dispensing region such that the dispensing region is only connected to the storage region through web members defined about the decoupling member, wherein a transfer of any bow force from the storage region to the bottom edge is substantially eliminated.

19. The vending machine according to claim 18, wherein each of the plurality of column walls includes top, bottom and intermediate portions, said top and intermediate portions defining the storage region and said bottom portion defining the dispensing region.

20. The vending machine according to claim 19, wherein each of the plurality of column walls includes a plurality of integrally formed stiffening elements extending between the side edges.

21. The vending machine according to claim 20, wherein each of the top, bottom and intermediate portions includes at least one of the plurality of stiffening elements,

22. The vending machine according to claim 20, wherein each of the plurality of stiffening elements defines an elongated, narrow slot.

23. The vending machine according to claim 20, wherein each of the plurality of stiffening elements is stamped from the material sheet

24. The vending machine according to claim 19, wherein each of the plurality of column walls includes an integrally formed alignment member.

25. The vending machine according to claim 24, wherein the integrally formed alignment member is formed in the dispensing region.

26. The vending machine according to claim 25, wherein the integrally formed alignment member includes a guide element, said guide element being adapted to guide the product container away from the column wall.

27. The vending machine according to claim 26, wherein the decoupling element is arranged below the integrally formed alignment member.

28. A method of forming a column wall used to form a stack area from product containers to be dispensed from a vending machine comprising:

providing a substantially rectangular metal sheet having top, bottom, and opposing side edges that define a substantially planar wall surface;

forming a plurality of vertically spaced stiffening elements out of the wall surface, wherein at least one of the plurality of stiffening elements comprises a decoupling member isolating a first area of the column wall from a second area of the column wall to minimize forces in the first area from being transferred to the second area; and creating an integrally formed alignment member along the wall surface for positioning product containers for proper dispensing purposes.

29. The. method of claim 28, further comprising: forming each of the plurality of stiffening elements with a fore-to-aft extending slot in the wall surface.

30. The method of claim 29, wherein the column wall includes upper, intermediate and lower portions, at least one of the stiffening elements being formed in the lower portion to decouple the lower portion from the upper and intermediate portions.

31. The method of claim 29, further comprising: interconnecting at least two of the plurality of stiffening elements through a stiffener structure.

32. The method of claim 28, further comprising: stamping each of the plurality of stiffening elements from the column wall.

33. The method of claim 28, further comprising: stamping the integrally formed alignment member from the column wall.

* * * * *